US008141506B2

(12) United States Patent
Hall et al.

(10) Patent No.: US 8,141,506 B2
(45) **Date of Patent: *Mar. 27, 2012**

(54) SYSTEM AND METHOD FOR CONTROL OF THE BACKING FEED FOR A TUFTING MACHINE

(75) Inventors: Wilton Hall, Ringgold, GA (US); William M. Christman, Jr., Hixson, TN (US)

(73) Assignee: Card-Monroe Corp., Chattanooga, TN (US)

( * ) Notice: Subject to any disclaimer, the term of this patent is extended or adjusted under 35 U.S.C. 154(b) by 289 days.

This patent is subject to a terminal disclaimer.

(21) Appl. No.: 12/563,534

(22) Filed: Sep. 21, 2009

(65) Prior Publication Data

US 2010/0064954 A1 Mar. 18, 2010

Related U.S. Application Data

(63) Continuation of application No. 11/209,053, filed on Aug. 22, 2005, now Pat. No. 7,717,051.

(60) Provisional application No. 60/603,614, filed on Aug. 23, 2004.

(51) Int. Cl.
*D05B 1/00* (2006.01)

(52) U.S. Cl. ..... 112/475.05

(58) Field of Classification Search ..... 112/80.18, 112/80.04, 80.31, 80.32, 80.4, 80.33, 80.73, 112/80.43, 470.03, 475.01, 475.02, 475.04, 112/475.05

See application file for complete search history.

(56) References Cited

U.S. PATENT DOCUMENTS

| | | | |
|---|---|---|---|
| 2,811,244 | A | 10/1957 | MacCaffray, Jr. |
| 2,818,037 | A | 12/1957 | McNutt |
| 2,840,019 | A | 6/1958 | Beasley |
| 2,842,259 | A | 7/1958 | Hoeselbarth |
| 2,866,424 | A | 12/1958 | Masland, II |
| 2,883,735 | A | 4/1959 | Hoeselbarth |
| 2,932,181 | A | 4/1960 | MacCaffray, Jr. |
| 2,965,054 | A | 12/1960 | Masland, II |
| 2,990,792 | A | 6/1961 | Norwicki et al. |
| 2,991,738 | A | 7/1961 | Zenner et al. |
| 2,968,856 | A | 12/1961 | Allen |
| 3,016,029 | A | 1/1962 | Card |
| 3,026,830 | A | 3/1962 | Bryant et al. |
| 3,059,596 | A | 10/1962 | Wade |
| 3,084,645 | A | 4/1963 | Card |
| 3,091,199 | A | 5/1963 | Ballard |
| 3,095,840 | A | 7/1963 | Ballard |

(Continued)

OTHER PUBLICATIONS

US 4,384,588, 05/1983, Slattery (withdrawn)

*Primary Examiner* — Tejash Patel
(74) *Attorney, Agent, or Firm* — Womble Carlyle Sandridge & Rice LLP

(57) ABSTRACT

A method of controlling the feeding of the backing material moving through a tufting machine in order to produce tufted articles such as carpets having a woven look or appearance. The backing material is indexed forwardly along its path of travel through the tufting machine by at least the stitch length for each stitch in a stitch cycle of the programmed pattern. At a desired point in the stitch cycle, the backing material can be indexed forwardly by a greater distance approximately equal to the program stitch length and a calculated jump distance to achieve a desired pattern effect.

10 Claims, 4 Drawing Sheets

U.S. PATENT DOCUMENTS 3,095,841 A 7/1963 Ballard
3,103,903 A 9/1963 Broadrick et al.
3,109,395 A 11/1963 Batty et al.
3,202,379 A 8/1965 Dedmon et al.
3,332,379 A 7/1967 Cobble, Sr. et al.
3,361,096 A 1/1968 Watkins
3,393,654 A 7/1968 Barnes
3,490,399 A 1/1970 Hesz
3,585,948 A 6/1971 Cobble
3,662,697 A 5/1972 Passons et al.
3,688,804 A 9/1972 Brown et al.
3,688,808 A 9/1972 Uehera
3,701,464 A 10/1972 Crum
3,721,203 A 3/1973 George
3,794,554 A 2/1974 Caring
3,806,013 A 4/1974 McGann
3,842,767 A 10/1974 Short
3,865,059 A 2/1975 Jackson
3,908,881 A 9/1975 McCann
3,919,953 A 11/1975 Card et al.
3,934,524 A 1/1976 Smith
3,943,865 A 3/1976 Short et al.
3,972,295 A 8/1976 Smith
3,982,491 A 9/1976 Herzer et al.
4,010,700 A 3/1977 Webb
4,048,930 A 9/1977 Card
4,089,281 A 5/1978 Landoni
4,100,863 A 7/1978 Shortie, Jr.
4,103,629 A 8/1978 Card
4,127,078 A 11/1978 Spanel et al.
4,134,347 A 1/1979 Jolley et al.
4,173,192 A 11/1979 Schmidt et al.
4,193,358 A 3/1980 Woodcock
4,221,317 A 9/1980 Fukada et al.
4,224,884 A 9/1980 Shortie, Jr.
4,244,309 A 1/1981 Spanel et al.
4,245,794 A 1/1981 Hasegawa et al.
4,254,718 A 3/1981 Spanel et al.
4,255,050 A 3/1981 Beckstein et al.
4,261,498 A 4/1981 Short
4,267,787 A 5/1981 Fukuda
4,303,024 A 12/1981 Bardsley
4,303,189 A 12/1981 Wiley et al.
4,365,565 A 12/1982 Kawai et al.
4,366,761 A 1/1983 Card
4,370,937 A 2/1983 Denny
4,399,758 A 8/1983 Bagnall
4,401,024 A 8/1983 Frentress
4,419,944 A 12/1983 Passons et al.
4,440,102 A 4/1984 Card et al.
4,445,447 A 5/1984 Bradsley et al.
4,448,137 A 5/1984 Curtis et al.
4,483,260 A 11/1984 Gallant
4,501,212 A 2/1985 Slattery
4,549,496 A 10/1985 Kile
4,557,208 A 12/1985 Ingram
4,586,445 A 5/1986 Card et al.
4,597,344 A 7/1986 Stutznacker
4,619,212 A 10/1986 Card et al.
4,630,558 A 12/1986 Card et al.
4,653,293 A 3/1987 Porat
4,653,413 A 3/1987 Bagnall
4,665,845 A 5/1987 Card et al.
4,669,171 A 6/1987 Card et al.
4,682,554 A 7/1987 Goto et al.
4,686,918 A 8/1987 Hjalmer et al.
4,741,000 A 4/1988 Fukuda
4,786,177 A 11/1988 Beckstein et al.
4,794,874 A 1/1989 Slattery
4,815,401 A 3/1989 Bagnall
4,815,403 A 3/1989 Card et al.
4,817,541 A 4/1989 Magourik
4,829,917 A 5/1989 Morgante et al.
4,831,948 A 5/1989 Itoh et al.
RE32,967 E 6/1989 St. John et al.
4,836,118 A 6/1989 Card et al.
4,867,080 A 9/1989 Taylor et al.
4,890,924 A 1/1990 Beckstein
4,903,624 A 2/1990 Card et al.
4,903,625 A 2/1990 Card et al.
4,981,091 A 1/1991 Taylor et al.
4,991,523 A 2/1991 Ingram
5,005,498 A 4/1991 Taylor et al.
5,035,030 A 7/1991 Pellari
5,058,518 A 10/1991 Card et al.
5,080,028 A 1/1992 Ingram
5,165,352 A 11/1992 Ingram
5,205,233 A 4/1993 Ingram
5,224,434 A 7/1993 Card et al.
5,267,520 A 12/1993 Ingram
5,295,450 A 3/1994 Neely
5,383,415 A 1/1995 Padgett, III
5,392,723 A 2/1995 Kaju
5,400,727 A 3/1995 Neely
5,416,593 A 5/1995 Cercruysse
5,461,996 A 10/1995 Kaju
5,480,085 A 1/1996 Smithe et al.
5,484,639 A 1/1996 Woodall et al.
5,491,372 A 2/1996 Erhart
5,495,815 A 3/1996 Bagnall
5,499,588 A 3/1996 Card et al.
5,513,586 A 5/1996 Neely et al.
5,526,760 A 6/1996 Ok
5,544,605 A 8/1996 Frost
5,549,064 A 8/1996 Padgett, III
5,557,154 A 9/1996 Erhart
5,562,056 A 10/1996 Christman, Jr.
5,566,630 A 10/1996 Burgess et al.
5,588,383 A 12/1996 Davis
5,622,126 A 4/1997 Card et al.
5,662,054 A 9/1997 Bardsley
5,706,744 A 1/1998 Card et al.
5,706,745 A 1/1998 Neely et al.
5,738,030 A 4/1998 Ok
5,743,200 A 4/1998 Miller et al.
5,743,201 A 4/1998 Card et al.
5,794,551 A 8/1998 Morrison et al.
5,806,446 A 9/1998 Morrison et al.
5,809,917 A 9/1998 McGowan et al.
5,896,821 A 4/1999 Neely et al.
5,979,344 A 11/1999 Christman, Jr.
5,983,815 A 11/1999 Card
5,989,368 A 11/1999 Tillander et al.
6,009,818 A 1/2000 Card et al.
6,213,036 B1 4/2001 Slattery
6,244,203 B1 6/2001 Morgante et al.
6,729,254 B2 5/2004 Mamiya
6,776,109 B2 8/2004 Segars et al.
6,782,838 B1 8/2004 Segars
6,834,601 B2 12/2004 Card et al.
6,834,602 B1 12/2004 Hall
6,902,789 B2 6/2005 Funasako
7,426,895 B2 9/2008 Smith et al.
7,717,051 B1 * 5/2010 Hall et al. ..... 112/475.05
2002/0067483 A1 6/2002 Lacovara

* cited by examiner

SYSTEM AND METHOD FOR CONTROL OF THE BACKING FEED FOR A TUFTING MACHINE

CROSS REFERENCE TO RELATED APPLICATIONS

The present patent application is a is a continuation of co-pending U.S. patent application Ser. No. 11/209,053, filed Aug. 22, 2005, which patent application is a formalization of previously filed U.S. Provisional Patent Application Ser. No. 60/603,614, filed Aug. 23, 2004, by the inventors named in the present application. This patent application claims the benefit of the filing date of the cited provisional patent application according to the statutes and rules governing provisional patent applications, particularly 35 U.S.C. §119(e)(1) and 37 CFR §1.78(a)(4) and (a)(5). The specification and drawings of the provisional patent application as well as those of the co-pending non-provisional application are specifically incorporated herein by reference.

FIELD OF THE INVENTION

The present invention generally relates to systems and methods for forming tufted articles, and in particular to a method and system for controlling the advancement of a backing material through a tufting machine for the formation of tufted patterns therein.

BACKGROUND OF THE INVENTION

Patterned, tufted articles, such as carpets, have become increasingly popular in recent years, especially with the advent of computerized and servomotor controls for various aspects of tufting machines, which have significantly expanded the number of pattern effects and styles that now can be produced. The formation of programmed designs or patterns within tufted carpets or rugs generally has been accomplished through (i) control of yarns being fed to various needles of a tufting machine, typically through the use of pattern attachments such as roll or scroll attachments; (ii) by the lateral shifting of one or two needle bars of the tufting machine to locate stitches or tufts at various laterally shifted positions as the backing material is moved underneath the needles; and/or (iii) by shifting the primary backing material laterally, typically in machines using a floating head and a reduced number of needles (i.e., one).

It has also been known to use a combination of one or more of yarn feed control, shifting of a needle(s) and or shifting of the primary backing to form desired pattern effects in the backing. For example, by using yarn feed controls to feed more or less yarn (i.e., back rob the yarns), different color yarns can be placed at laterally displaced locations, with lowered tufts or ends of yarns created by the shifting of needle(s) and back-robbing of the yarns fed to the shifting needles being buried or hidden by other tufts.

While such patterning systems or devices have enabled an increasing array of different styles and/or pattern effects to be formed in carpets, there is still a limit in the type of patterns or "looks" that can be achieved with such patterning devices. In addition, pattern attachments such as roll or scroll attachments further can significantly add to the complexity and cost of a tufting machine, while the burying of yarns requires higher pile heights to cover such buried yarns, thus adding further costs to the finished carpet. Further, tufting machines that utilize the lateral shifting of the primary backing generally have limited production rates or capacities, and typically are used mainly as specialty machines, such as for producing patterned carpets and rugs. In addition, to provide rugs or carpets with a "woven look" as opposed to a "tufted appearance," it typically has been necessary to use specialty machinery, such as weaving looms or other dedicated machinery, which can be more costly and labor intensive operate to produce such woven carpets.

Accordingly, it can be seen that a need exists for a system and method for forming patterned, tufted articles that address the forgoing and other related and unrelated problems in the art.

SUMMARY OF THE INVENTION

Briefly described, the present invention generally relates to a system and method for controlling the feeding of a backing material through a tufting zone of a tufting machine to produce patterned tufted articles such as carpets, rugs, and the like. The backing feed control system and method of the present invention generally includes a controller or is part of a control system for the tufting machine, having a computer or processor that monitors and controls the operative elements of the tufting machine according to the programmed pattern instructions. The tufting machine generally will include a yarn feed system having a series of driven yarn feed rolls that typically are driven by servomotors or other similar drives under the control of the tufting machine control system. The yarn feed system can also include various pattern attachments such as roll or scroll pattern attachments, single end yarn feed controls, etc.

The yarn feed system will feed a series of yarns to corresponding needles of the tufting machine. The tufting machine can include a single staggered needle bar having two spaced rows of needles separated by a desired stagger, typically ⅛" to upwards of 1", although greater or lesser staggers can also be used. However, it will also be understood by those skilled in the art that the tufting machine further could include a pair of needle bars, each carrying a spaced row of needles to which the various yarns are fed by the yarn feed system. Still further, the needle bar or needle bars also can be shiftable needle bars to enable further pattern effects.

Backing feed rolls will be mounted at the upstream and downstream portions of the tufting zone of the tufting machine for controlling the feeding of the backing material and applying tension control to the backing material as it is fed to the tufting zone of the tufting machine. The backing feed rolls generally will be driven by one or more motors, such as servomotors, stepper motors, vector motors, AC motors, DC motors, or other similar drives, under control of the backing feed control system of the present invention. The motors of the backing feed rolls being monitored by the tufting machine control system will be indexed or advanced so as to move the backing feed forwardly through the tufting zone at desired increments according to a pre-programmed stitch rate.

With the backing feed control system of the present invention, the yarn feed and backing feed for the tufting machine will be controlled according to preset pattern information for forming a desired pattern in the backing material, which pattern information generally will include preferred stitch rates for each stitch in the pattern. The pattern further can be arranged or segmented into stitch cycles or pattern cycles of two or more stitches, typically between 2-4 stitches per cycle. At the conclusion of each stitch cycle, the tufting machine control system will index the backing material forwardly by an increased amount of advancement corresponding to a programmed stitch rate and a calculated jump distance. The total stitch length and the calculated jump distance for the stitches formed during each stitch cycle further generally will be approximately equivalent to the stagger between the needles.

In operation of the backing feed control system of the present invention, at least two consecutive stitches will be sewn by each of the needles of the staggered needle bar(s) prior to the advancement or jumping of the backing material. This can be alternated with straight, conventional stitch formation, with the jumps/advancement of the backing material timed as needed or desired to form a programmed pattern. Additionally, the jumps can be timed in relation to control of a yarn feed attachment such as a scroll, roll, or other yarn feed attachment. The tufting machine control system will monitor each stitch according to the pattern instructions and will control the feeding of the backing material to slow or delay movement of the backing material through the tufting zone as the needle penetrates the backing material to form the tufts of yarn therein. Thereafter, while the needles are partially or fully out of the backing material, the backing material typically will be advanced forwardly by the desired stitch length, and if needed, the calculated jump distance. The control system further typically will monitor the position of the main shaft so as to determine when needles are leaving the backing material or are at a desired position out or nearly out of the backing material so as to begin advancement of the backing material and complete the advancement or indexing thereof in sufficient time prior to the needles finishing their downward stroke.

As a result, the backing feed control system and method of the present invention will enable the formation of two or more consecutive, in line longitudinally extending rows of tufts to be formed across the face of the carpet using the same inline row of needles (i.e., first row of needles) without the yarns from the second or staggered row of needles being intermixed therebetween.

Various objects, features and advantages of the present invention will be apparent to those skilled in the art upon the review of the following detailed description when taken into conjunction with the accompanying drawings.

DESCRIPTION OF THE INVENTION

Referring now in greater detail to the drawings in which like numerals indicate like parts throughout the several views, the present invention is directed to a system 10 and method for controlling the movement of a backing material 11 through a tufting machine 12 in order to produce tufted articles such as carpets that have enhanced pattern effects, such as providing the carpets with a woven look or appearance, as opposed to a traditional tufted appearance, without requiring highly specialized machinery for producing woven carpets or rugs.

Figure 1:
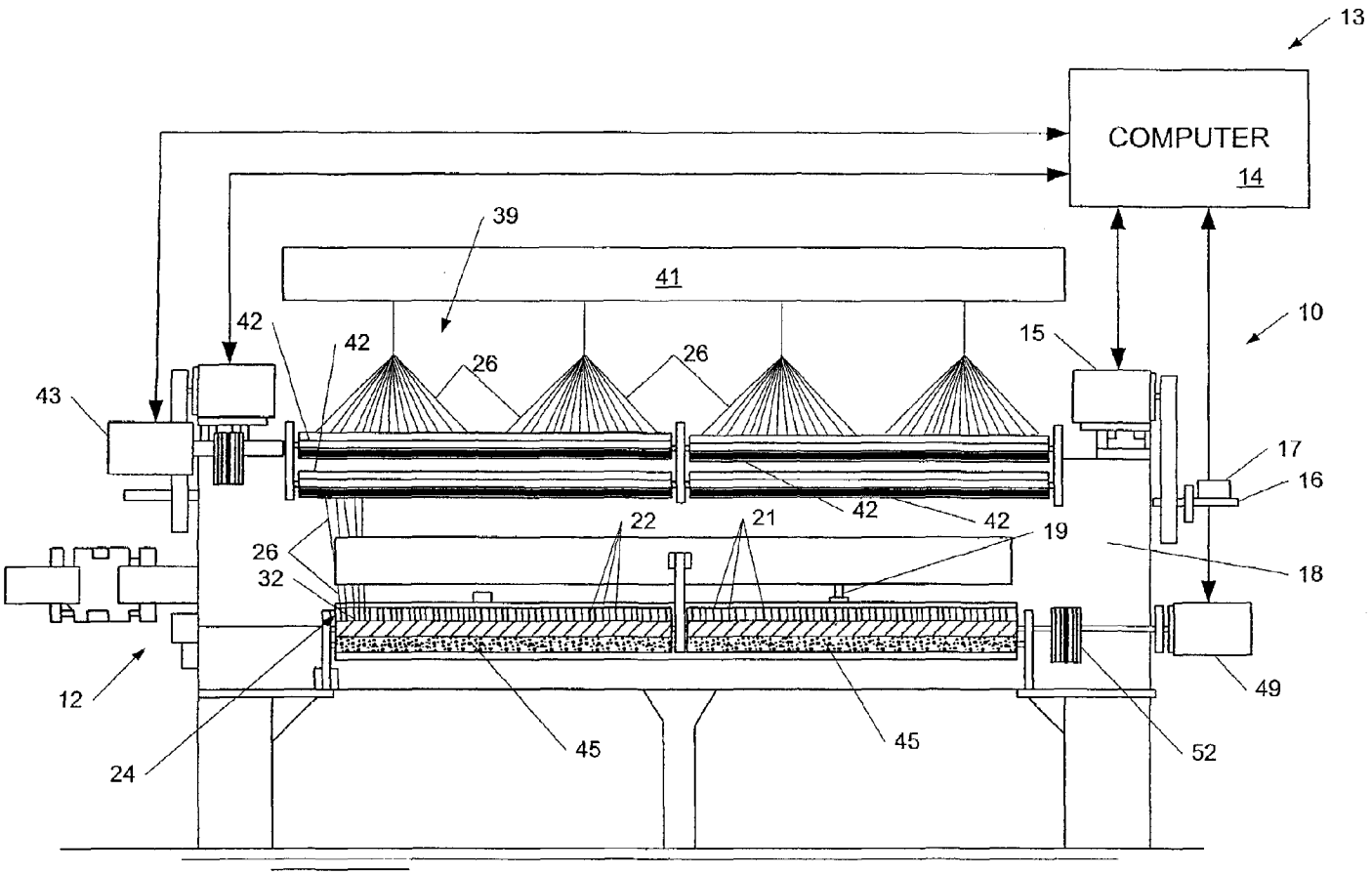
FIG. 1 is an end view of a tufting machine utilizing the system for controlling the backing feed control according to the present invention.
Figure 2:
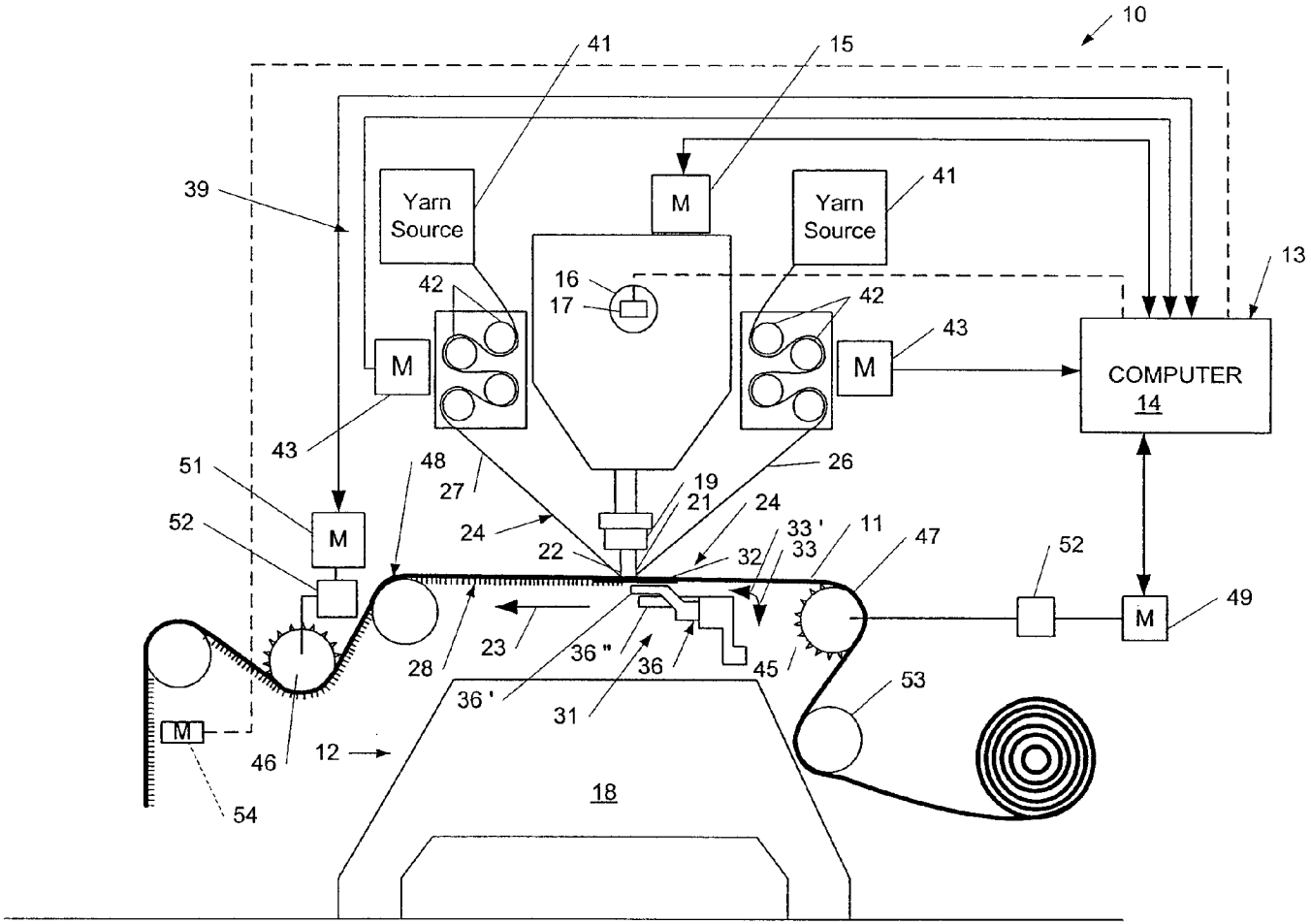
FIG. 2 is a side elevational view schematically illustrating a tufting machine incorporating the system for controlling the backing feed of the present invention.

As generally indicated in FIGS. 1 and 2, the backing feed control system 10 can be mounted on or included as part of a computer control system for the tufting machine 12, generally indicated at 13, such as a "Command Performance" tufting machine computer control system manufactured by Card-Monroe Corp. Such a tufting machine control system 13 will include a computer controller or processor 14 that can be programmed with pattern information for forming various desired tufting patterns. The controller 14 will be in communication with and can be programmed to control various operative features and functions of the tufting machine, including monitoring and controlling one or more motors 15 driving the main shaft 16 of the tufting machine. An encoder 17 (FIG. 2), such as an absolute encoder, incremental encoder, resolver or similar monitoring device, generally will be mounted on the main shaft 16 for detecting and providing feedback information regarding the position of the main shaft during rotation thereof. Additionally, the controller system typically will include a user interface (not shown) such as a touch screen, keyboard, and mouse, tablet, or other similar input device to enable operator input and programming of the controller 14. The control system 13 further can be connected to a separate pattern design center or can include pattern design functionality or capability to enable creation and programming of patterns therein.

As indicated in FIGS. 1 and 2, the tufting machine 12 used with the present invention generally will include a frame 18 on which the main shaft 16 and drive motor 15 are supported for reciprocally driving at least one staggered needle bar 19. The needle bar 19 typically carries two laterally extending rows of parallel needles 21 and 22, respectively, with the rows of needles being staggered longitudinally in the direction of feed (indicated by arrow 23) of the backing material 11. The stagger between the two rows of needles 21 and 22 can be any practical stagger, for example approximately ⅛ inch to upwards of 1 inch, although greater or lesser staggers (i.e., 1/16" or less or greater than 1" also can be used as will be understood in the art. As a further alternative, as will be understood in the art, two spaced needle bars, which can be fixed or shifting needle bars, that each can be shifted via a shifter mechanism, such as a cam or "SmartStep" shifter control mechanism by Card-Monroe Corp., in a transverse direction with respect to the backing material, and which each carry a row of spaced needles therealong, also can be used in place of a single staggered needle bar 19.

A tufting zone 24 thus is defined in the space below the needles 21 and 22, through which the backing material 11 is passed as it is moved in the direction of arrow 23 through the tufting zone. As the needle bar is reciprocally driven by the main drive shaft 16, the needles 21 and 22 are moved vertically between a raised portion out of engagement with the backing material and a lowered position penetrating the backing material for inserting yarns 26 and 27 therein.

As indicated in FIGS. 1 and 2, a plurality of yarns 26/27 will be fed to each of the needles 21 and 22 of the needle bar 19, with at least a first series of yarns 26 typically being fed to one row of needles, such as 21, and at least a second set or series of yarns 27 being fed to the other row of needles 22, as illustrated in FIG. 2. The yarns in each series of yarns can be of varying colors, types, sizes and/or textures so as to provide different desired pattern effects and variations in color, and are carried with their respective needles into and through the backing material during a tufting cycle to thus form a series of stitches or tufts 28 in the backing material 11 in a desired pattern, as indicated in FIGS. 3A and 3B.

Figure 3A:
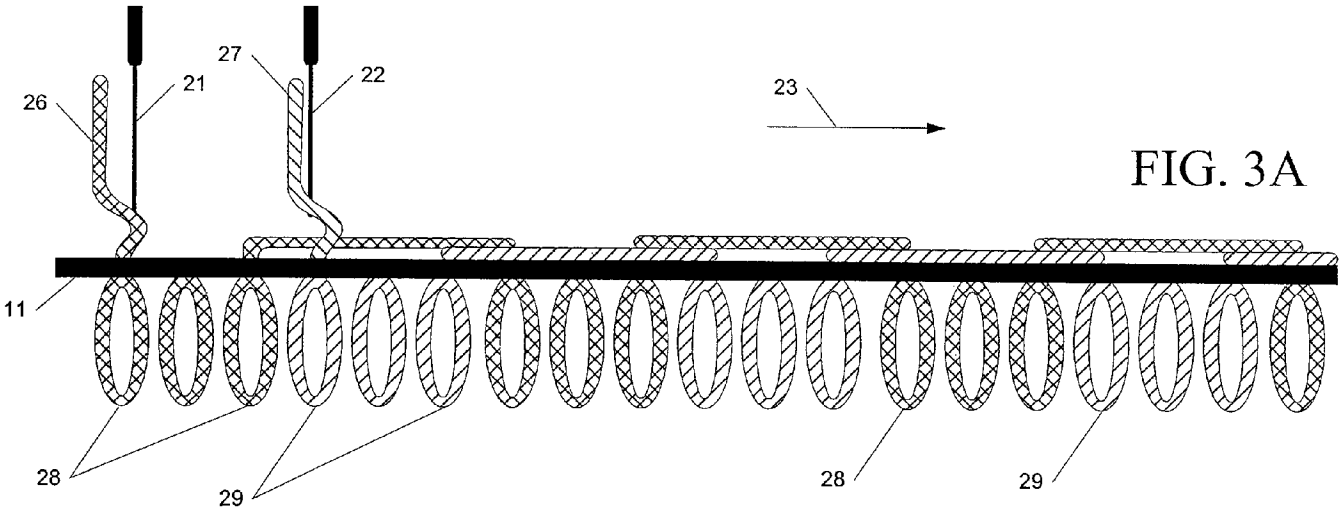
FIG. 3A is a side elevational view illustrating the sewing of tufts of yarn in the backing material by the needles of front and rear needle bars according to the method of the present invention as illustrated in FIGS. 1 and 2.
Figure 3B:
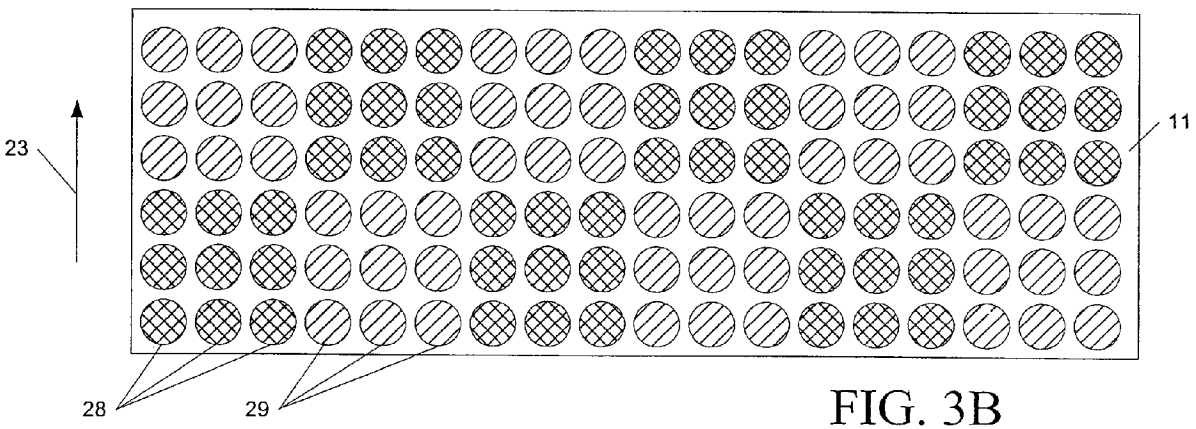
FIG. 3B is a top plan view of a pattern formed using the system and method of controlling the backing feed according to the present invention.

As shown in FIG. 2, loopers 31 generally are mounted below the tufting zone 24 and bed 32 of the tufting machine and generally are movable as indicated by arrows 33/33' into engagement with the needles 21 and 22 as the needle penetrate the backing material 11, striking the needles and pulling loops of the yarns 26/27 therefrom to form the tufts 28 and 29 (FIGS. 3A and 3B). The loopers can be both loop pile loopers, such as shown at 36, both cut pile hooks, loop pile loopers 36 and cut pile hooks, cut/loop loopers, or level cut loop ("LCL") loopers that include a controlled pattern reciprocating looper with a clip therealong. As illustrated in FIG. 2, in a loop pile arrangement, the loopers typically will be arranged with the loop pile loopers 36 mounted along the upstream side of the tufting zone, with there typically being a first set of loopers 36' for the row of first needles and a second, starter set of loopers 36" for the second row of needles. Alternatively, a "Velva-Loop" type arrangement can be used, with loopers mounted on the upstream side and a series of cut pile hooks mounted along the downstream side of the tufting zone as disclosed and claimed in U.S. Pat. No. 6,834,602, the disclosure of which is incorporated herein by reference as if set forth fully herein.

As further illustrated in FIGS. 1 and 2, the yarns 26/27 generally will be fed through a yarn feed system 39 from a yarn source 41 to each of the needles 21 and 22. The yarn feed system generally will include a series of yarn feed rolls 42 that can be driven by one or more drive motors 43 (such as a servo or stepper motor, vector motor, AC motor, DC motor or other drive motor) under the control of the computer 14 of the tufting machine control system 13. As indicated in FIGS. 1 and 2, however, a single drive motor 43 also can be used for driving at least one of the yarn feed rolls directly, with the remaining yarn feed/puller rolls being driven off the servo driven yarn feed roll. In addition to the control of the movement of the backing material 11, the yarn feed system also can be controlled by the control of the operation of the yarn feed puller rolls to feed more or less yarns for a desired stitch of a preprogrammed pattern to provide additional patterning effects such as high/low or sculptured effects. Still further, the yarn feed system 39 can include various pattern attachments such as servomotor driven yarn feed rolls, electro-mechanical or air operated clutches, single or double/dual yarn feed systems, and/or servo driven roll or scroll type pattern attachments, including single end scroll attachments, such as the systems disclosed and claimed in co-owned U.S. Pat. Nos. 6,807,917 and 6,834,601, the disclosures of which are incorporated by reference as if set forth fully herein, and other pattern attachments such as a Yarntronics or Quickthread pattern attachment as manufactured by Card-Monroe Corp, which can be used with the system and method of the present invention to provide further patterning variations and effects.

The backing feed control system 10 of the present invention further includes backing or cloth feed rolls 45 and 46 mounted at the front or upstream edge 47 and the rear or downstream edge 48, respectively, of the tufting zone 24 of the tufting machine 12, as indicated in FIG. 2. Each of the backing feed rolls 45 and 46 generally will be controlled/driven by a motor 49 or 51, respectively, that communicates with and is controlled by the computer 14 of the tufting machine control system 13. The motors 49 and 51 typically are servomotors, although other variable speed motors, such as stepper motors, vector motors, AC motors, DC motors, and/or other type actuators or drive systems also can be used. In addition, as further indicated in FIG. 2, gear boxes 52 also can be used for assisting in the driving of the backing feed rolls 45/46 by their drive motors 49/51 to provide a desired gear reduction or drive ratio as needed. It further will be understood that while a pair of motors 49 and 51 are shown for driving each of the backing feed rolls 45 and 46 respectively, it is also possible to utilize one motor, such as either motor 49 or motor 51 for driving either the front or rear backing feed roll, with the other backing feed roll being driven by belt drive or other linkage connecting it in a driven relationship to the motor controlled/driven backing feed roll. The driving of the backing feed rolls will be controlled in order to maintain tension control to the backing material 11 as it is fed through the tufting zone in the direction of arrow 23, as well as to cause a "jump" or advancement of the backing material as needed to form desired pattern effects in the tufted article being manufactured.

In operation of the backing feed control system 10 of the present invention, the computer 14 of the tufting machine control system 13 generally will be programmed with a desired pattern, with each stitch of the pattern having a desired or prescribed stitch length, i.e., 0.050-0.075 inch, although a variety of greater or lesser desired stitch rates or lengths can be used. The pattern generally will be organized into stitch cycles or repeats of generally two to four stitches per cycle, although more stitches per cycle also potentially could be used. In addition, the movement of the backing feed is generally made according to a stitch or backing feed profile determined by: (1) the stitch length of the particular stitch in the current stitch cycle of the pattern and any calculated jump distance or additional advancement/indexing of the backing feed required (which could be equal to zero where no jump or additional indexing is required); (2) the percentage of backing material advance allowed versus main shaft rotation (i.e., the backing material could be limited in its movement to only when the needles are out or nearly out of the backing material, which could be approximately 30-40% of the time for a single rotation of the main shaft, with the backing material staying constant, being paused, or slowed to a desired rate, the remaining percent of the time); and/or (3) a phase advance setting based upon the rotation or position of the main shaft, whereby the computer can initiate the operation of the servomotor(s) or drives controlling the movement of the backing material as (or immediately prior to) the needles are being moved out of the backing material to their raised, non-engaging position.

Figure 4:
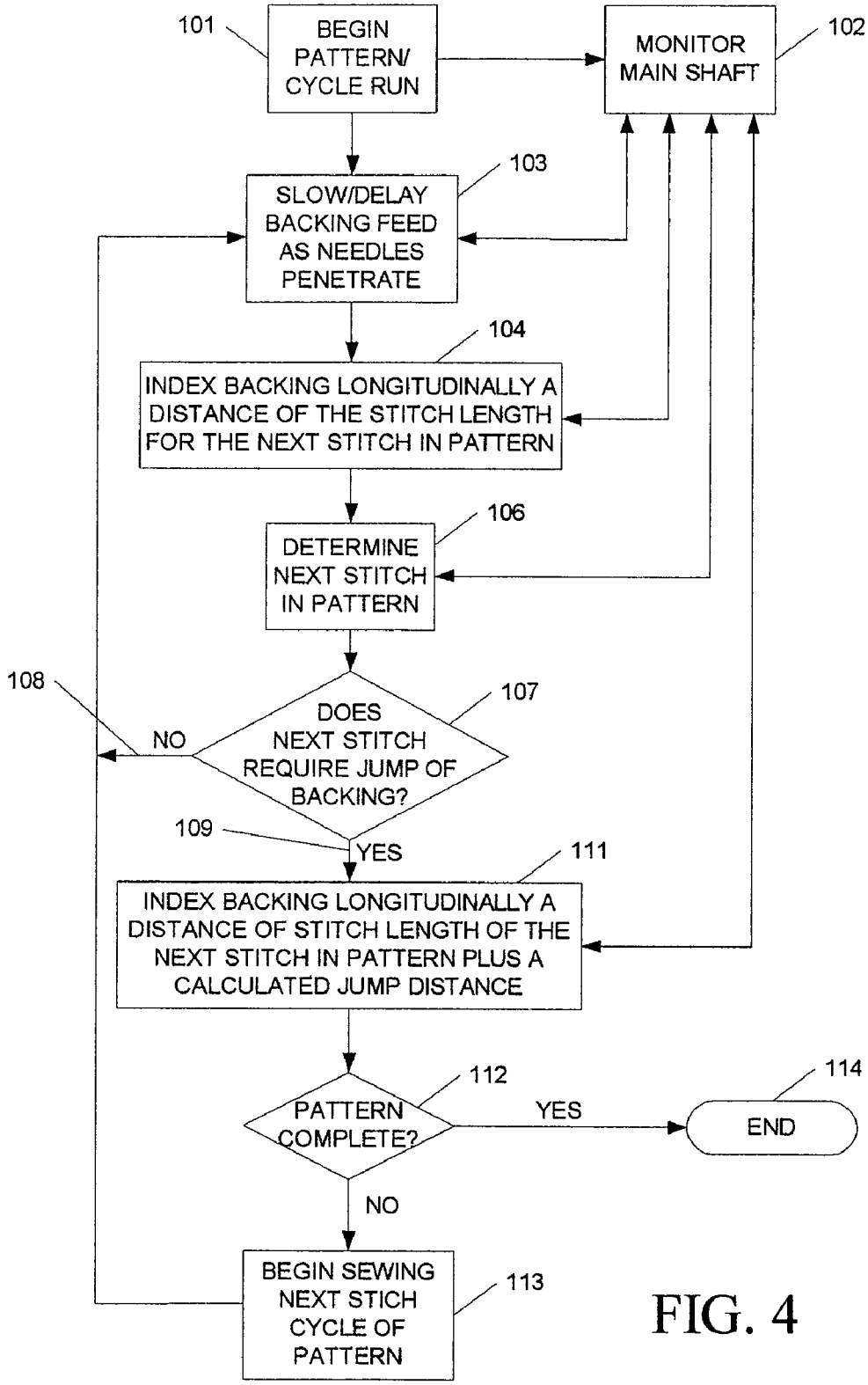
FIG. 4 is a flow diagram illustrating the method of controlling the backing feed according to the present invention.

As illustrated in FIG. 4, as the pattern or each stitch cycle or repeat thereof is commenced at step 101, the computer of the tufting machine control system will monitor the operation of the main shaft of the tufting machine, such as via the encoder on the main shaft or other, similar measuring device measuring incremental position or rotation of the main shaft, as well as monitor the backing feed and yarn feed motors as noted at 102. The main shaft is monitored to determine the position of the needles during each stroke so as to determine whether the needles are at any given point in the formation of a stitch (i.e., as the needles penetrate the backing material and when the needles are moving out of the backing material). As indicated at 103 in FIG. 4, as the needles penetrate the backing material, the feed or longitudinal movement of the backing material through the tufting zone generally may be slowed. It is also possible that the movement of the backing material can be paused or delayed as the needles penetrate the backing material to prevent tearing of the backing material and/or breaking of the needles. Thereafter, during the initial step(s) or stitches of a stitch cycle, as shown at 104, as the needles are removed from the backing material, the backing material typically is indexed longitudinally a distance approximately equal to the programmed stitch length for the next stitch in the pattern to be sewn.

The computer will then check the pattern information for the next stitch to be sewn in the pattern (106) to determine whether or not the next stitch would require a jump or additional movement of the backing material, as indicated at 107. This check can be done at about the same time as the backing is being indexed or can be done a desired number of stitches in advance so that the jump or additional movement, if required, can be accounted for by beginning the movement of the backing material as soon as possible during the needle stroke cycle. If the next stitch of the pattern requires the backing material to be indexed only by the proscribed stitch length, i.e., no jump or additional movement is required (arrow 108), the system repeats/continues its cycle of possibly slowing or delaying the backing feed as the needles penetrate the backing material, followed by the indexing of the backing material to the stitch length of the next stitch being sewn in the pattern cycle. For example, the system can be programmed with a phase advance setting to begin the indexing of the backing material at substantially the same time, or even just prior to, the needles being moved out of the backing material to ensure there is sufficient time between the needles leaving and re-penetrating the backing material during a needle stroke or cycle to move the backing material the desired amount of advancement with the potential engagement and tearing of the backing material or damage to the needles due to movement of the backing material with the needles inserted therein being minimized.

If the next stitch of the pattern cycle does require a jump or additional advancement of the backing material (shown by arrow 109), the backing material is indexed forwardly, longitudinally by a distance of the stitch length of the next stitch in the pattern, plus a calculated jump distance as indicated at 111. For example, during a three stitch cycle of the programmed pattern, the linear motion of the backing material may advance 0.075 inches for a first and second stitch, and thereafter advance 0.350 inches (0.075 inches plus a "jump" of 0.275 inches) for the third stitch of the cycle or repeat. Typically, the total movement of the backing material, including its prescribed stitch length and calculated jump distance during each repeat or cycle of stitches will be approximately equal to the stagger between the first and second rows of needles, i.e., 0.75"+0.75"+0.350"=0.5" inner stagger.

Thereafter the system continues to run successive stitch repeats or cycles of the pattern (as indicated by step 112) until the desired run length of carpet to be produced has been completed (113), after which the pattern run or tufting operation can be ended (114) and the system can be shut down.

The method of the present invention enables two or more consecutive, inline, longitudinally extending rows of tufts 28/29 (FIGS. 3A-3B) to be formed across the face of the carpet using the same inline row of needles, without the yarn from other rows of needles being intermixed between such consecutive longitudinal rows as generally shown in FIGS. 3A and 3B. As a result, with the method of the present invention, groupings of different yarns (i.e., a first grouping of yarns of one color and a second group of yarns of a different color) can be discretely inserted in longitudinal tuft rows such that tufted articles having a "woven" look can now be produced, with the patterns being produced generally being cleaner and more precise with less buried ends, which enables lower weight carpets to be produced and further enables carpets with very low pile heights, where there are no buried ends to be covered.

The backing feed control system further can be intermixed with conventional or regular stitches alternating from one stitch formed by the first row of needles with the second row of stitches formed by the second row of needles, and with the needles being shifted as needed to form programmed pattern effects/stitches between the jumps of the backing material for the formation of pattern elements or effects by the backing control system. For example, straight or conventional stitches can be formed between diamond, star, or other geometric pattern effects formed by the backing control.

In addition, the backing feed control system of the present invention further can be used in conjunction with additional pattern devices or systems, as discussed above, such as using shifting needle bars in place of the staggered needle bar 19 (FIG. 2), the use of opposite hand loopers and cutting, as disclosed in U.S. Pat. No. 6,834,602, the disclosure of which is incorporated herein. It is also possible to use servo driven puller rolls as discussed above, as well as servomotor driven pattern attachments that include one or more servomotor driven yarn feed rolls, electromechanical clutches, single or double yarn feed roll systems, and/or even single end yarn feed control systems or attachments. Still further, other options can include the use of positive stitch placement or level cut loop systems.

It will be further understood by those skilled in the art that while the present invention has been described above with reference to preferred embodiments, numerous variations, modifications, and additions can be made thereto without departing from the spirit and scope of the present invention as set forth in the following claims.

What is claimed:

1. A tufting machine comprising:

backing feed rolls;

at least one servomotor for driving the backing feed rolls for moving a backing fabric longitudinally through the tufting machine in a feeding direction;

a first row of needles substantially uniformly spaced transversely of the feeding direction;

a second row of needles substantially uniformly spaced transversely of the feeding direction and longitudinally spaced from said first row of needles;

a needle drive including a needle bar for reciprocating said first and second rows of needles toward and away from the backing fabric to penetrate the backing fabric;

wherein the at least one servomotor for moving the backing fabric longitudinally through the tufting machine is controllable to feed different lengths of the backing fabric between selected cyclical penetrations of the backing fabric in accordance with a predetermined pattern; and wherein the first and second rows of needles are supported in spaced series along the needle bar.

2. The tufting machine of claim 1, wherein the first and second rows of needles are staggered relative to one another.

3. A tufting machine comprising:

a servo motor driven mechanism for moving a backing fabric longitudinally through the tufting machine in a feeding direction;

a first row of needles spaced transversely of the feeding direction;

a second row of needles spaced transversely of the feeding direction and longitudinally spaced from said first row of needles;

a needle drive for reciprocating said first and second rows of needles towards and away from a first side of the backing fabric to penetrate the backing fabric;

wherein the mechanism for moving the backing fabric longitudinally through the tufting machine is controllable to feed different lengths of backing fabric between selected cyclical penetrations of the backing fabric in accordance with a predetermined pattern; and wherein the tufting machine is adapted to feed the backing fabric a first length on selected stitches and a second length on other selected stitches, the first length being of a different length than the second length.

4. A tufting machine comprising:

a drive mechanism for moving a backing fabric longitudinally through the tufting machine in a feeding direction;

a first row of needles uniformly spaced transversely of the feeding direction;

a second row of needles uniformly spaced transversely of the feeding direction and longitudinally spaced from said first row of needles;

a needle drive for reciprocating said first and second rows of needles towards and away from a first side of the backing fabric to penetrate the backing fabric;

one or more yarn feed devices feeding yarns to the first row of needles, and one or more yarn feed devices feeding yarns to the second row of needles; and wherein the drive mechanism for moving the backing fabric longitudinally through the tufting machine is electronically controllable to feed different lengths of backing fabric between selected cyclical penetrations of the backing fabric in accordance with a predetermined pattern.

5. A method of controlling a tufting machine of the type having a servo motor driven mechanism for moving a backing fabric longitudinally through said machine in a feeding direction; a first row of needles spaced transversely of the feeding direction; a second row of needles spaced transversely of the feeding direction and longitudinally spaced from the first row of needles; and a needle drive for reciprocating the first and second rows of needles towards and away from the backing fabric to cyclically penetrate the backing fabric, the method comprising the steps of:

(a) setting a first length to feed the backing fabric;

(b) setting a second length to feed the backing fabric;

(c) setting a number of stitches in a backing fabric feed pattern repeat;

(d) setting the stitches of the backing feed pattern repeat that will feed the backing fabric the second length; and (e) feeding different lengths of the backing fabric between selected penetrations of the backing fabric.

6. A method of adapting a tufting machine of the type having a servo motor driven mechanism for moving a base fabric longitudinally through said machine in a feeding direction; a first row of needles uniformly spaced transversely of the feeding direction; a second row of needles uniformly spaced transversely of the feeding direction and being longitudinally spaced from said first row of needles; and a needle drive for reciprocating said first and second rows of needles towards and away from a first side of the base fabric to cyclically penetrate the base fabric, to feed different lengths of base fabric between selected cyclical penetrations of the base fabric, comprising the steps of:

(a) setting a first length to feed the base fabric;

(b) setting a second length to feed the base fabric;

(c) setting a number of stitches in a base fabric feed pattern repeat; and (d) setting the stitches of the base fabric feed pattern repeat that will feed the base fabric the second length.

7. A method of tufting a fabric with a tufting machine, comprising:

(a) operating a needle drive to tuft a first stitch of yarns carried by needles of a first row of needles and a first stitch of yarns carried by needles of a second row of second needles longitudinally spaced from the first row of needles;

(b) operating a servomotor driven mechanism to feed a first length of a backing fabric through the tufting machine;

(c) operating the needle drive to tuft a second stitch of yarns carried by needles of the first row needles and a second stitch of yarns carried by needles of the second row needles; and (d) operating the servomotor driven mechanism to feed a second length of the backing fabric through the tufting machine, wherein the second length is of a different length than the first length.

8. The method of claim 7, wherein the tufting machine further comprises one or more yarn feed devices feeding yarns to the first row of needles, separate from one or more yarn feed devices feeding yarns to the second row of needles, and on a first stitch yarns are fed to at least some of the first needles at a rate different from the rate at which yarns are fed to at least some of the second needles.

9. The method of claim 7, wherein the resulting tufted fabric has a relatively uniform stitch density.

10. The method of claim 7, wherein the resulting tufted fabric has the appearance of a woven flat weave fabric.

* * * * *